United States Patent [19]

Fery

[11] 4,434,889

[45] Mar. 6, 1984

[54] GREETING CARD CONSTRUCTION

[76] Inventor: Guy A. Fery, 117 E. 57th St., New York, N.Y. 10022

[21] Appl. No.: 346,441

[22] Filed: Feb. 8, 1982

[51] Int. Cl.[3] ..... B65D 69/00; B65D 27/06; B65D 27/08

[52] U.S. Cl. ..... 206/216; 206/232

[58] Field of Search ..... 206/216, 232, 390, 494; 229/73

[56] References Cited

U.S. PATENT DOCUMENTS

| | | | |
|---|---|---|---|
| 321,297 | 6/1885 | Hoffman | 229/73 |
| 1,040,004 | 10/1912 | Patton | 229/73 |
| 1,985,114 | 12/1934 | Storer | 206/232 |
| 2,241,673 | 5/1941 | Mogabgab | 206/232 |
| 2,559,000 | 7/1951 | Back | 312/31 |
| 2,716,558 | 8/1955 | Sullivan | 150/1.7 |
| 2,799,391 | 7/1957 | Eisner | 206/232 |
| 3,278,015 | 10/1966 | Bernstein | 206/232 |
| 3,307,687 | 3/1967 | Steinman | 206/233 |
| 3,804,323 | 4/1974 | Bemel | 206/232 |

*Primary Examiner*—William T. Dixson, Jr.
*Assistant Examiner*—Brenda J. Ehrhardt
*Attorney, Agent, or Firm*—Wolder, Gross & Yavner

[57] ABSTRACT

A greeting card construction includes a message-conveying section comprising at least one panel and a collapsable receptacle affixed to the message conveying section. Upon receipt the collapsable receptacle can be removed from the remainder of the construction and be utilized as desired. Both the message-conveying section and the receptacle may be adorned with appropriate indicia.

11 Claims, 7 Drawing Figures

FIG. 1
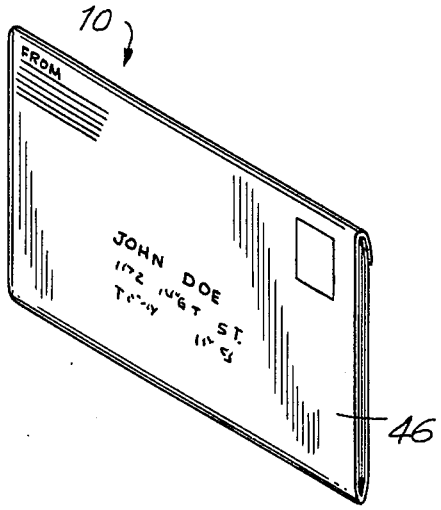
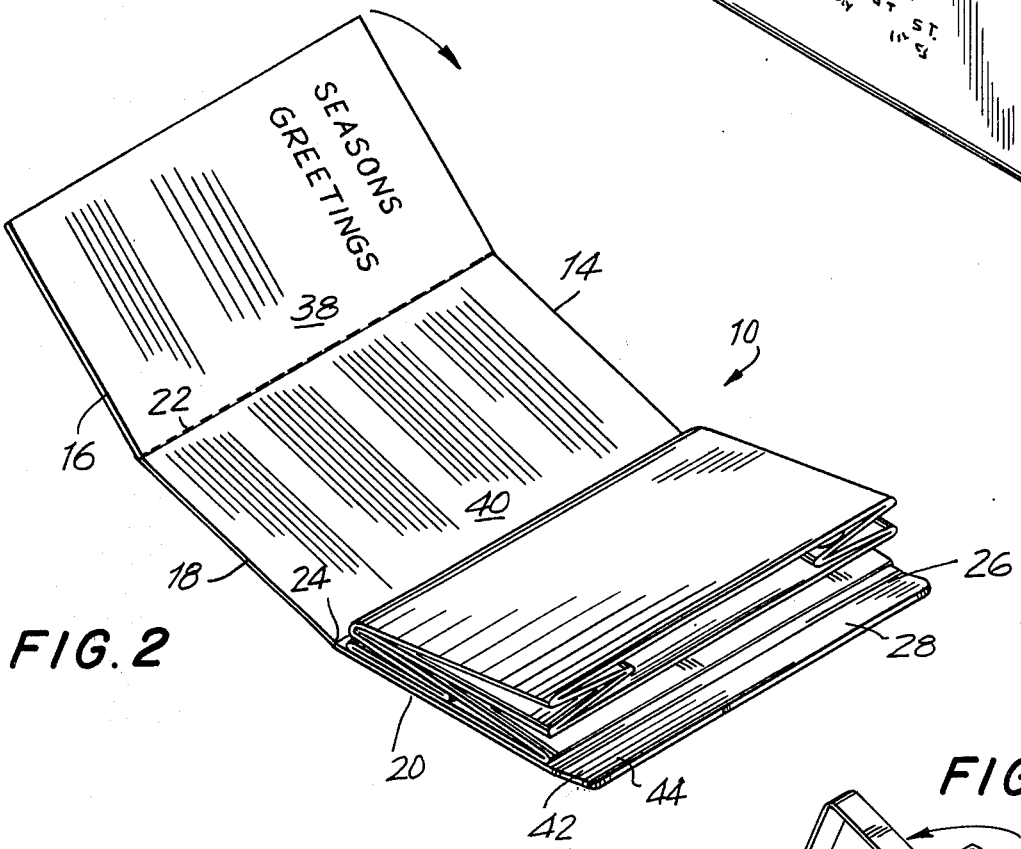
FIG. 2
FIG. 3
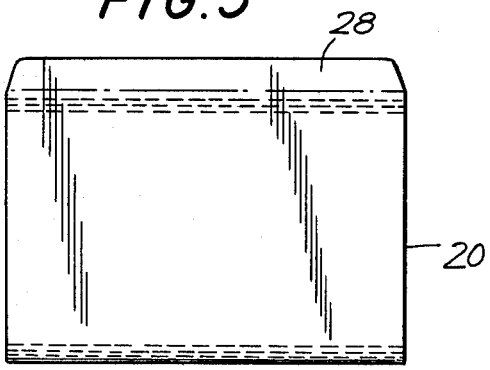
FIG. 4
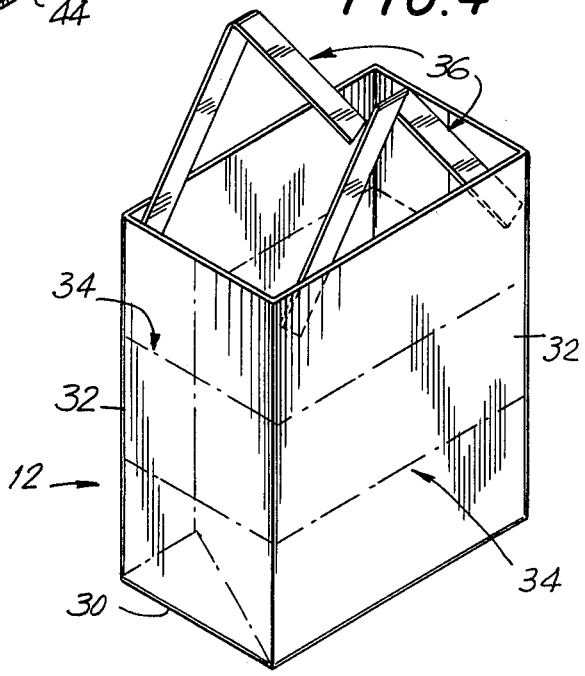

FIG. 5
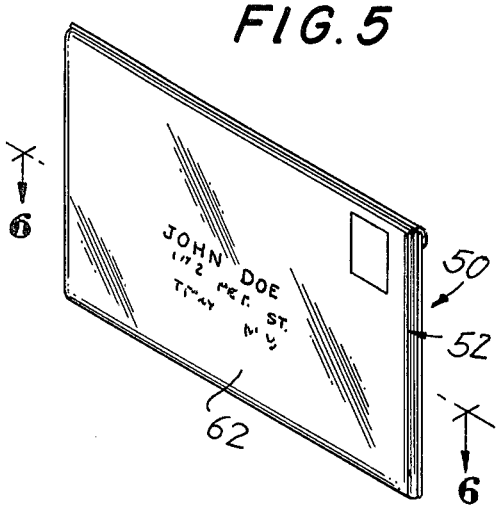
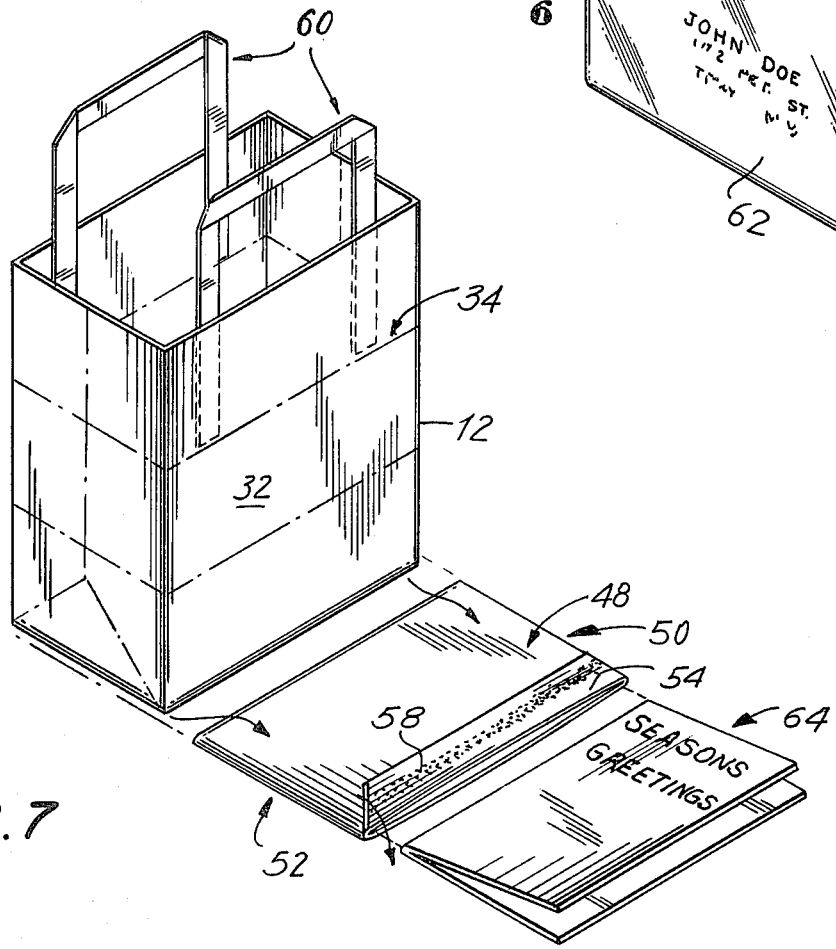
FIG. 7
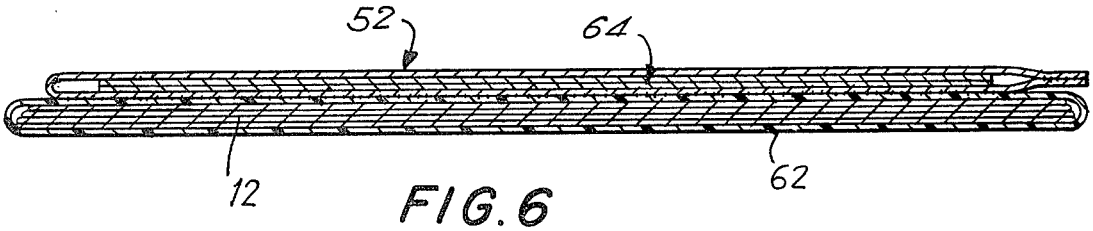
FIG. 6

GREETING CARD CONSTRUCTION

BACKGROUND OF THE INVENTION

The present invention relates to a greeting card and, in particular, to a greeting card which includes as an integral part thereof a collapsable container or receptacle which may be opened by the recipient and used in the appropriate manner.

A typical greeting card, while indicating to the recipient the concern and wishes of the sender, is a device of limited practicality. Soon after receipt by the recipient the card is often discarded, its message having been duly received and noted by the person to whom it was sent. It is therefore an object of the present invention to provide a greeting card which may be utilized for something additional than the mere transmission of sentiments or thoughts.

In accordance with the present invention a greeting card or envelope including an integrally mounted and folded paper or other flexible material container is provided. The container is so dimensioned as to be foldable to a size compatible with the dimensions of the greeting card or envelope, and is removably mounted to one surface thereof. Additional card or envelope surfaces are provided for addressing purposes as well as the communicating of the appropriate sentiment. The foldable container or receptacle itself may be provided with appropriate indicia to coordinate and further reinforce the tenor of the greeting card.

BRIEF DESCRIPTION OF THE DRAWINGS

A complete understanding of the present invention, as well as further objects and features thereof, can be obtained by reference to the following description of preferred, but nonetheless illustrative embodiments of the present invention when taken in conjunction with the annexed drawings, wherein:

FIG. 1 is a perspective view of a first embodiment of the invention showing the greeting card in the folded configuration for mailing;

FIG. 2 is a perspective view of the embodiment of FIG. 1 shown in the opened state, illustrating the exposed message area as well as the folded container or receptacle;

FIG. 3 is a plan view of the front of the first embodiment, showing the location of score lines provided to assist in receptacle removal from the card body;

FIG. 4 is the container of FIGS. 1 and 2 in the removed and unfolded configuration;

FIG. 5 is a perspective view of a second embodiment, in the folded form ready for mailing;

FIG. 6 is a sectional view taken along line 5—5 of FIG. 4, showing the card structure as well as that of the enclosed container; and FIG. 7 is a perspective view of the greeting card of FIG. 4 showing the message removed from the envelope and the container in the unfolded configuration.

DESCRIPTION OF THE PREFERRED EMBODIMENT

Referring initially to FIGS. 1–4, greeting card construction 10 includes foldable receptacle or container 12 and multi-panel card structure 14. In the embodiment shown in FIGS. 1–4 card 14 includes panels 16, 18 and 20 interconnected by fold line 22 between panels 16 and 18 and fold line 24 between panels 18 and 20. Fold lines 22 and 24 may be created by a partial cut through the panel material or by any other appropriate means. Appended to edge 26 of third panel 20 and preferably formed from the same material as panels 16 through 20 is sealing flap 28.

Receptacle 12, which can be seen in its unfolded state in FIG. 4, is manufactured of any appropriate material, such as craft paper or light gauge plastic. Receptacle 12 includes a generally flat base 30, which is dimensioned to overlie third panel 20. Sides 32 of the receptacle 12 are provided with appropriate fold lines 34 to allow the container to be collapsed to the folded state. Handles 36, which may be similarly constructed of a heavy gauge paper, are provided at the top of the receptacle, and may be folded inwardly when the receptacle is in the collapsed position.

Container base 30 is fastened to the third panel 20 by an adhesive chosen to retain the receptacle thereon, but which permits the receptacle to be removed from the panel with minimal damage thereto. Any one of several paper adhesives sold under the term "rubber cement" for example, may be used. Alternatively, panel 20 may be provided with perforation or score lines 37, which allow receptacle 12 to be removed along with a portion of panel 28. In such an embodiment receptacle base 30 may be permanently affixed to panel 20, which when removed from the card structure provides additional base rigidity for the receptacle.

The dimensions of panels 16, 18 and 20 are chosen such that inner face 38 of panel 16 may be folded to overlay inner face 40 of panel 18, and that both panels in such a folded configuration may be folded over receptacle 12 when in the collapsed state. Upon such folding flap 28, which includes on its inner face 42 an appropriate sealing adjesive, is fastened to the edge of panel 16, thus securing the construction in its folded state. As so folded, as shown in FIG. 1, outer surface 46 of panel 18 can be utilized for the placement of an address and postage.

Prior to sealing, surfaces 38 and 40 may be utilized by the sender to write an appropriate message. Alternatively, those surfaces may be pre-printed with sentiments appropriate for the occasion. Receptacle container 12 may similarly be adorned with indicia appropriate for the occasion. Upon receipt by the recipient flap 28 is opened, the massage on surfaces 38 and 40 received, and receptacle container 12 may then be removed from the remainder of the construction, thus providing a useful item and an item which will serve as a continuous remainder to the recipient of the sentiments of the sender.

A second embodiment of the present invention can be seen in FIGS. 5–7. In this embodiment receptacle/container 12 is placed upon outside surface of panel 48 of envelope construction 50, into which an appropriate message-bearing card or letter 52 may be inserted. Envelope 50 includes both panels 48 and 52, which, as may be best seen in FIG. 5, are joined along three edges of their periphery to form the envelope chamber. Panel 48 includes integral sealing flap 54 which may be folded over the edge of panel 52 to seal the envelope after the card or letter is inserted. Sealing flap 54 contains glue line 58 to provide the sealing function.

Receptacle 12, which rests upon the outer surface of panel 48, includes fold lines 34 on its sides 32 to allow it to be folded to a size commensurate with the size of panel 48. As shown in FIG. 6, foldable handles 60 may be alternatively of a square, rather than the triangular configuration shown in FIG. 3. As may be best seen in FIG. 6, receptacle container 12 is enclosed in an impervious covering 62 to keep it in its folded state and protect it during display and mailing. Packaging 62 may be of a transparent and flexible thin plastic film. The enclosed receptacle container 12 is then adhesively attached to panel 48. In the embodiment of FIGS. 5–7, envelope construction 50 is used in the conventional manner, with the recipient's address and postage being affixed to the outer surface 56 of panel 52. Enclosed message card or letter 64 is inscribed with the appropriate sentiment, while receptacle 12 may be similarly adorned.

The present invention provides a greeting card construction having a utility and value which extends beyond that of the conventional card. The incorporation of a removable receptacle container to a card or envelope construction permits the recipient to utilize a section of the greeting past the time when conventional cards are usually discarded, thus providing a more meaningful vehicle for the transmission of sentiments between the sender and recipient.

While the foregoing has been applied to specific illustrative embodiments, it is recognized that numerous modifications and adaptations to the invention are possible and are intended to be within the scope of the invention herein.

I claim:

1. A greeting card construction comprising a first panel joined to a second panel by a first fold line, a third panel joined to said second panel by a second fold line, said first and second panels being adapted for the display of printed indicia thereon, and a collapsable receptacle having a base and upwardly projecting sides, said base being removably affixed to said third panel, said sides being foldable upon said base such that said third panel may be folded along said second fold line into a position overlying said second panel with said receptacle in its folded configuration lying therebetween.

2. The construction of claim 1 wherein said collapsable receptacle is of paper.

3. The apparatus of claim 1 wherein said base is coextensive with said third panel.

4. The apparatus of claim 1 wherein said receptacle further comprises a pair of foldable handles.

5. A greeting card construction comprising two or more panels joined seriatim along fold lines therebetween and a collapsable receptacle removably attached to a surface of one of said panels, said receptacle being collapsable to a form in which it overlies and is coextensive with the panel to which it is attached.

6. The apparatus of claim 5 wherein said receptacle includes a base and a plurality of sides extending upwardly from said base, said base being removably attached to one of said panels.

7. A greeting card construction comprising two or more panels joined seriatim along fold lines therebetween and a collapsable receptacle having a base and a plurality of upward extending sides, said base being formed from at least part of one of said panels, said base forming panel part being removable from the other of said panels so that said receptacle may be removed from said greeting card construction.

8. A greeting card construction comprising an envelope formed of a first and a second panel affixed to each other to form a message retaining pocket therebetween, and a collapsable receptacle removably attached to one of said panels, said receptacle being collapsable to form in which it is co-extensive with the panel to which it is attached.

9. The apparatus of claim 8 wherein said receptacle includes a base and a plurality of sides extending upwardly from said base, said base being removably attached to one of said panels.

10. The apparatus of claim 8 wherein said receptacle is retained in its collapsed form by a protective wrapping overlying said receptacle.

11. The apparatus of claim 10 wherein said wrapping is of plastic film.

* * * * *